US005707297A

United States Patent [19]

Shu

[11] Patent Number: 5,707,297

[45] Date of Patent: Jan. 13, 1998

[54] PRACTICE DEVICE FOR GOLFERS

[76] Inventor: Han Chung Shu, 5F, No. 205, Wu Shen Street, Taipei, Taiwan

[21] Appl. No.: 748,398

[22] Filed: Nov. 13, 1996

[51] Int. Cl.[6] ..... A63B 69/36

[52] U.S. Cl. ..... 473/220; 362/259

[58] Field of Search ..... 473/220; 362/259

[56] References Cited

U.S. PATENT DOCUMENTS 2,787,470 4/1957 Barrus et al. ..... 473/220

5,388,832 2/1995 Hsu ..... 473/220

*Primary Examiner*—George J. Marlo

*Attorney, Agent, or Firm*—Beveridge, DeGrandi, Weilacher & Young LLP

[57] ABSTRACT

Disclosed is a laser aiming device removably mounted on a putter mainly including a sidewardly opened clamping member and a laser emitter. The clamping member firmly clamps on a rear edge of a head portion of the putter with screws threading from a top surface of the clamping member downward toward the rear edge of the putter. A receiving seat is also provided on the top surface of the clamping member to receive a housing of the laser emitter. The laser emitter further includes a number of batteries and a laser producing means accommodated in the housing. The laser emitter is electrically connected to a pressure switch provided at a bottom surface of the clamping member when it is put into the receiving seat. When a putter mounted with the laser aiming device is used to practice putting, the user may gently press the putter against the ground to turn on the pressure switch and therefore causes the laser producing means to emit a laser beam which emits out of the housing above the head portion of the putter and can be aimed at a target of putting. The laser emitter can be conveniently removed from the putter so that the same putter can be immediately used in a game.

6 Claims, 5 Drawing Sheets

PRACTICE DEVICE FOR GOLFERS

BACKGROUND OF THE INVENTION

1. Field of the Invention

The present invention relates to a laser aiming device removably mounted on a putter. The laser aiming device can be conveniently mounted on the striking head of a putter to help a golfer to effectively practice putting, or be easily dismounted from the putter so that the putter can also be used in a game.

2. Description of the Prior Art

In a golf game, a putter is used on the green to accurately aim at the hole and then gently strike the golf ball for the same to roll on the grass and finally into the hole.

When putting, the putter must strike the golf ball at an angle about normal to the ground surface so that the hit golf ball can roll along the ground without flying. Since most part of the green is slope, the striking direction is a most important factor to determine whether the ball rolls into the hole or not. The correct aiming before striking requires frequent practice.

When practicing putting, the golfer must first learn to control his or her putter to secure a correct striking direction. That is, the golfer should practice striking on a level ground surface until the golf ball always roll toward the aimed direction. This is to train the golfer to always strike stably. When the golfer can always strike the ball stably, he or she will then learn to aim at the hole correctly. All of these require frequent and repeated practice.

To avoid practicing blindly, there are some aiming devices designed for using with a putter. One example is the provision of scales on top surface of the head portion of the putter. Other example includes the mounting of mirror or other aids on the head of putter. However, even with these conventional aiming devices, the golfer will more or less need to aim at the target visually. That is, these conventional aiming devices fail to fully accurately aim at and indicate the target. The golfer may need more efforts to practice than he or she expects.

Taiwanese Utility Model Patent Application Serial No. 83201562 titled "Practice Putter with Laser Indicating Means" discloses a putter with batteries and a contact switch mounted on the club thereof and a seat fixed to the head of putter to receive a laser emitter. A wire extends from the batteries and the contact switch on the club to the head of putter so as to electrically connect with the laser emitter. The laser emitter is controlled through the contact switch to emit a laser spot and thereby indicates the exact position the putter aims at. The putter disclosed in this patent application is indeed helpful in practicing golf. This putter is, however, used only in practicing putting and can not be used in a golf game. Other qualified putter must be used to replace it in a game. Since every clubs have different weight and torque, the golfer in a game might not play the golf so well as he or she does in practicing with the putter having aiming aids. Moreover, the putter disclosed in this patent application has considerably complicate structure, particularly the wire which must be threaded through the hollow space inside the club. It is therefore impractical in terms of the high manufacturing cost thereof.

SUMMARY OF THE INVENTION

A primary object of the present invention is to provide a laser aiming device removably mounted on a putter. The laser aiming device mainly includes a clamping member having a sideward opening for fixing to a rear edge of a head portion of the putter by means of screws, a laser emitter disposed on a top of the clamping member, and a pressure switch provided to a bottom of the clamping member and electrically connected to the laser emitter. When a user is practicing putting, he or she may gently press the putter against the ground so as to turn on the pressure switch at bottom. At this point, the laser emitter downward emits a light spot from a position slightly above a center of gravity of the putter head, indicating a point at which the putter is aimed. When the putter is to be used in a game, the laser emitter can be easily removed from the putter head without causing any inconvenience to the user.

Another object of the present invention is to provide a laser aiming device removably mounted on a putter which is simple in structure and economical in manufacturing cost, and is therefore competitive on the commercial market.

Other advantages of the present invention include:

1. The laser emitter may clearly indicate the point at which the putter is aimed and this is particularly helpful to a starter to practice on a level ground for stable striking. With the help of laser emitter, the starter can quickly find out the correct way to strike the golf ball.
2. An advanced learner may also use the present invention to practice aiming correctly on a slope.
3. The present invention can be conveniently assembled to be mounted onto or dismounted from a putter, so that the user may use the same putter in practicing or in a game to largely improve the effect of practice with the present invention.

BRIEF DESCRIPTION OF THE DRAWINGS

The structure, the operation and the function of the present invention can be best understood by referring to the following detailed description of the preferred embodiments and the accompanying drawings, wherein.

DETAILED DESCRIPTION OF THE PREFERRED EMBODIMENTS

Figure 1:
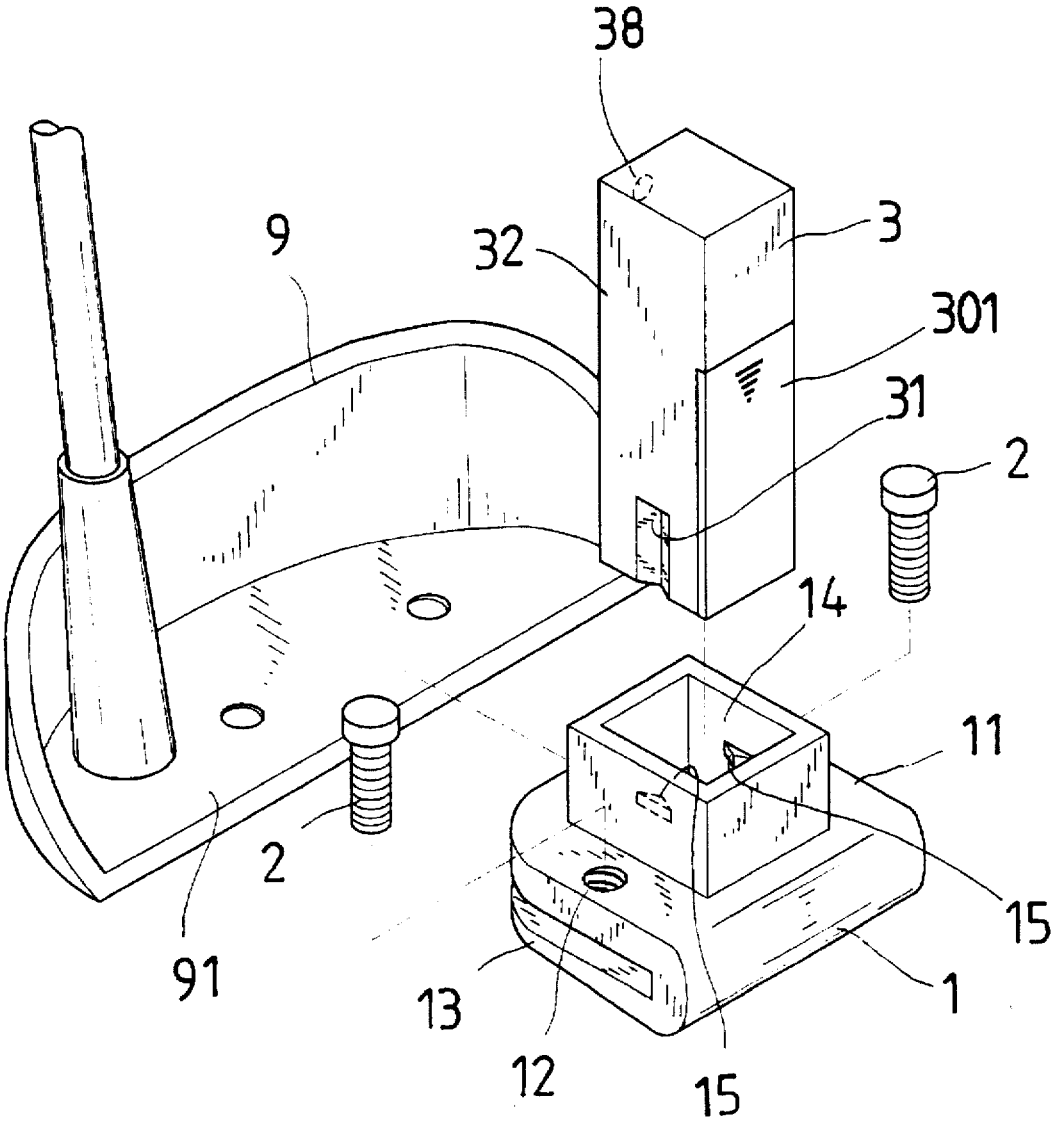
FIG. 1 is an exploded perspective of a first preferred embodiment of the present invention.
Figure 2:
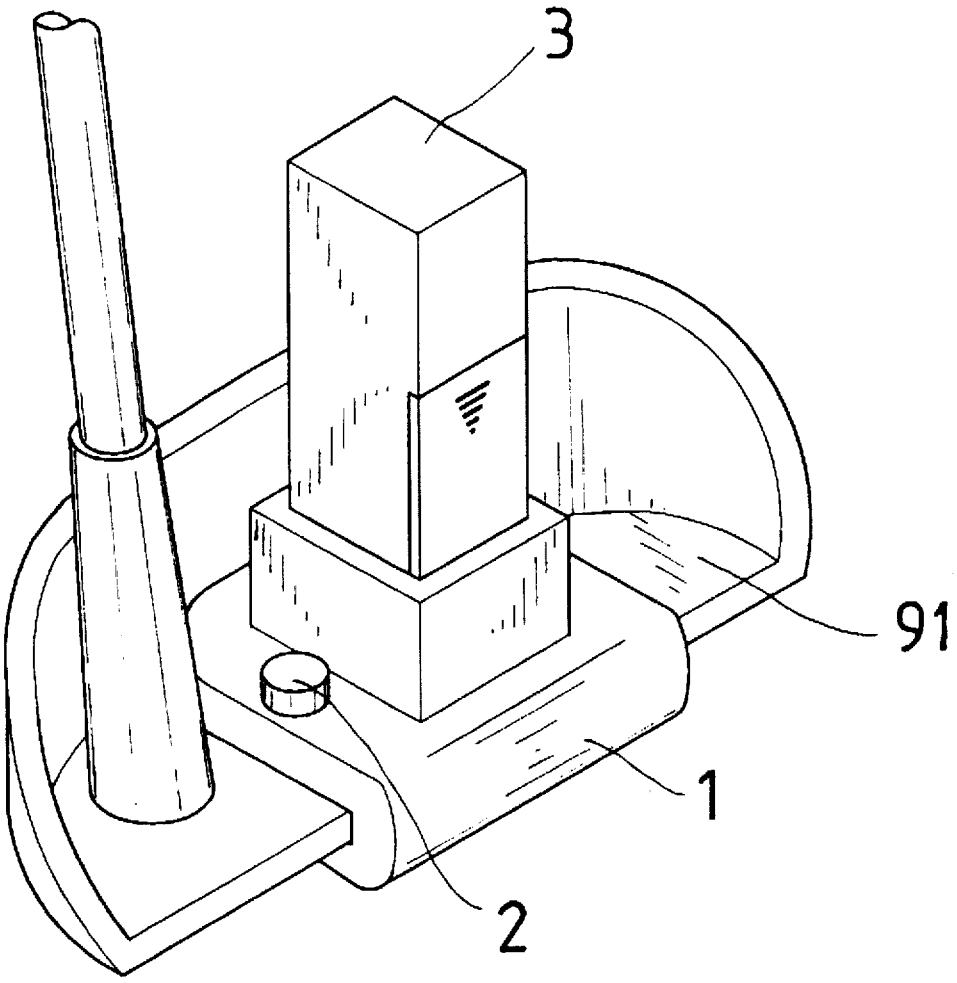
FIG. 2 is an assembled perspective of the first embodiment of the present invention shown in FIG. 1.

Please refer to FIG. 1 in which a first preferred embodiment of the present invention is shown. The present invention relates to a laser aiming device removably mounted on a putter and mainly includes a clamping member 1. The clamping member 1 further includes an upper leg 11 and a lower leg 13 which connect to each other at one end to together define a sideward opening for the clamping member 1. The upper leg 11 is formed with two threaded holes 12 for two screws 2 to thread into. The clamping member 1 is firmly mounted on a putter by engaging the sideward opening between the upper and the lower legs 11, 13 of the clamping member 1 with a rear edge 91 of a head portion 9 of the putter, and tightening the clamping member 1 to the head portion 9 of the putter by threading the screws 2 into the threaded holes 12. Of course, the clamping member 1 may also be firmly fixed to the rear edge 91 of the head portion 9 by other means, such as adhesive.

Figure 3:
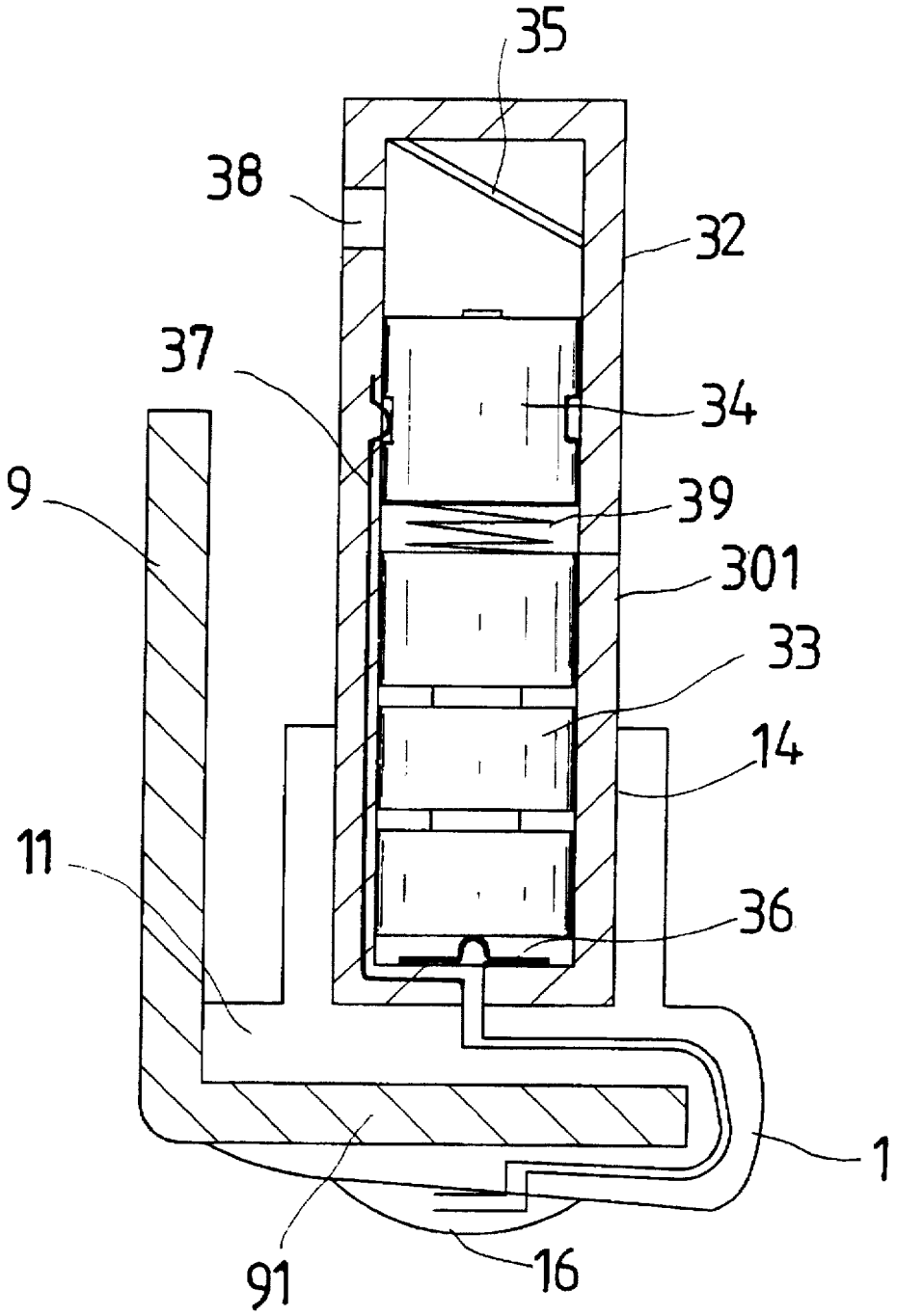
FIG. 3 is a side sectional view of the first embodiment of the present invention shown in FIG. 1.

A receiving seat 14 is provided on a top surface of the upper leg 11 of the clamping member 1 for detachably receiving a laser emitter 3 therein. In the first embodiment as shown in FIG. 1, the receiving seat 14 is a square framework. There are two electrode contacts 15 provided at two opposite inner side wall surfaces of the receiving seat 14. When the laser emitter 3 is received in the seat 14, the two electrode contacts 15 just contact with two electrode contacts 31 provided on the laser emitter 3 and make a closed circuit. The electrode contacts 15 of the receiving seat 14 is electrically connected to a pressure switch 16 provided at a bottom surface of the lower leg 13 of the clamping switch 1, as shown in FIG. 3.

Figure 4:
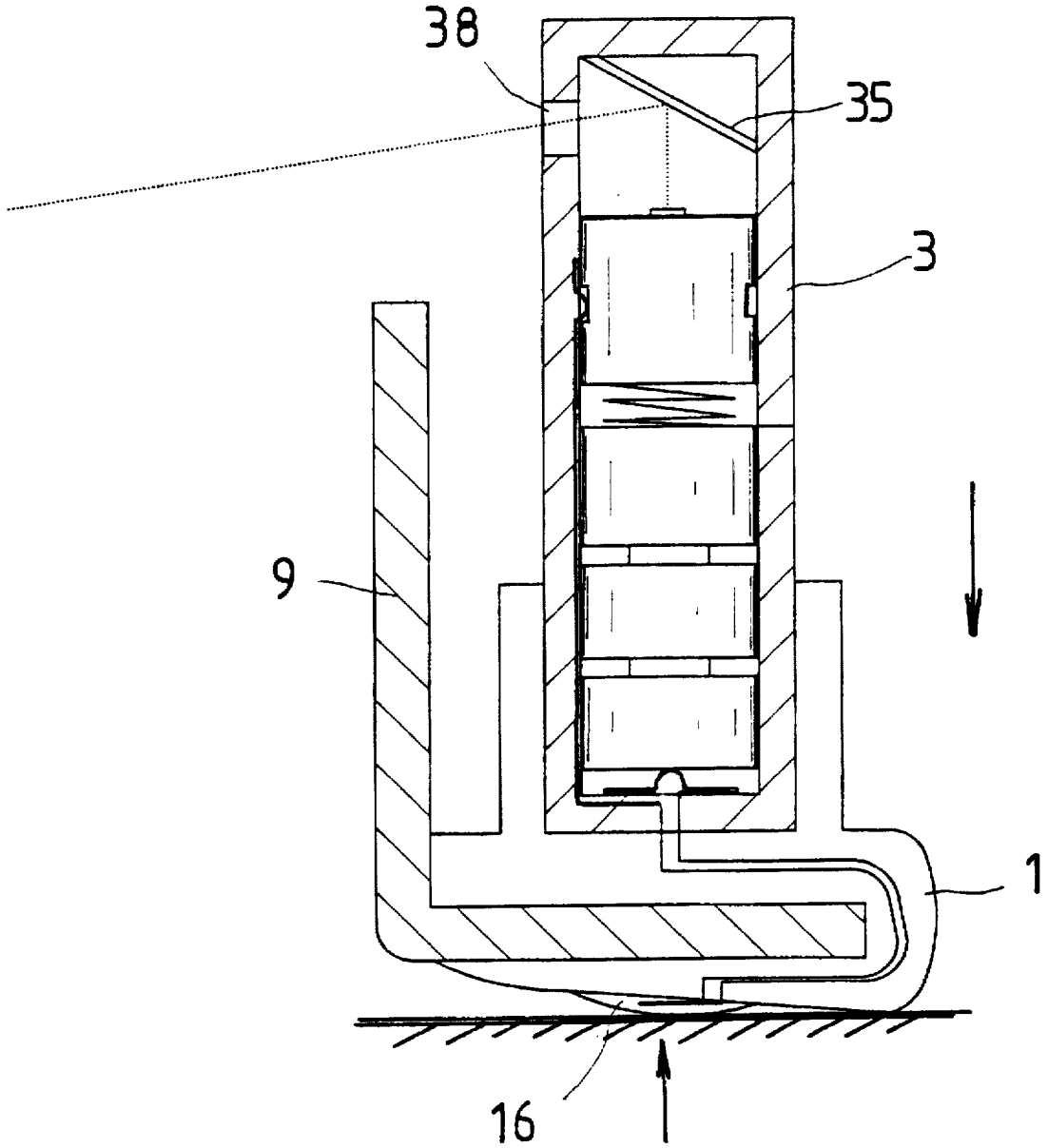
FIG. 4 is a side sectional view similar to FIG. 3 but with a pressure switch thereof depressed to electrically connect with the laser emitter for the latter to emit a light spot.

The laser emitter 3 has a housing 32. FIG. 3 illustrates an internal structure of the laser emitter 3. An adequate number of batteries 33, a laser producing means 34, and a mirror 35 are arranged in the housing 32. A metal spring 39 is disposed between the laser producing means 34 and the batteries 33 to, on the one hand, together with a bottom push plate 36 hold the batteries in place, and to, on the other hand, facilitate the replacement of batteries via a door 301 provided at, for example, a back side of the housing 32. The two electrode contacts 31 are provided on an outer surface of the housing 32 to separately electrically connect with the push plate 36 and an extension plate 37. The extension plate 37 has another end contacting with a contact on the laser producing means 34. By this way, a close circuit is formed when the laser emitter 3 is put into the receiving seat 14 of the clamping member 1. Whereby when the pressure switch 16 at the bottom of the lower leg 13 of the clamping member 1 contacts with the ground and is depressed, the switch 16 is turned on to cause the laser producing means 34 to emit a laser beam which is reflected by the mirror 35 disposed above the laser producing means 34 to emit out of the housing 32 from an opening 38 provided on the housing 32. The mirror 35 is so arranged that the laser beam is reflected at a desirable angle to finally emit from the opening 38 in a substantially horizontal but slightly downward inclined direction, as shown in FIG. 4. With the laser beam, a target can be accurately aimed at.

To use the present invention, first correctly attach the clamping member 1 to the rear edge of the head portion of the putter with the help of some auxiliary means, so that the laser emitter 3 can be correctly seated in the receiving seat 14 on the top of the clamping member 1 to allow the laser beam to emit from a point above a striking point on the head portion of the putter. When the laser emitter 3 has been seated in the receiving seat 14 of the clamping member 1, make sure the laser emitter 3 is electrically connected to the pressure switch 16. When the putter with the laser aiming device of the present invention mounted thereon is used to practice putting, gently press the putter downward so that the pressure switch 16 contacts with the ground to make the circuit, causing the laser emitting means to emit a laser beam to aim at the target.

When the same putter is to be used in a game, the user may simply remove the laser emitter 3 from the receiving seat of the clamping member 1, or detaches the whole laser aiming device from the head portion of the putter. There is no need to change another putter for the game. So, the laser aiming device of the present invention is very convenient in use.

Figure 5:
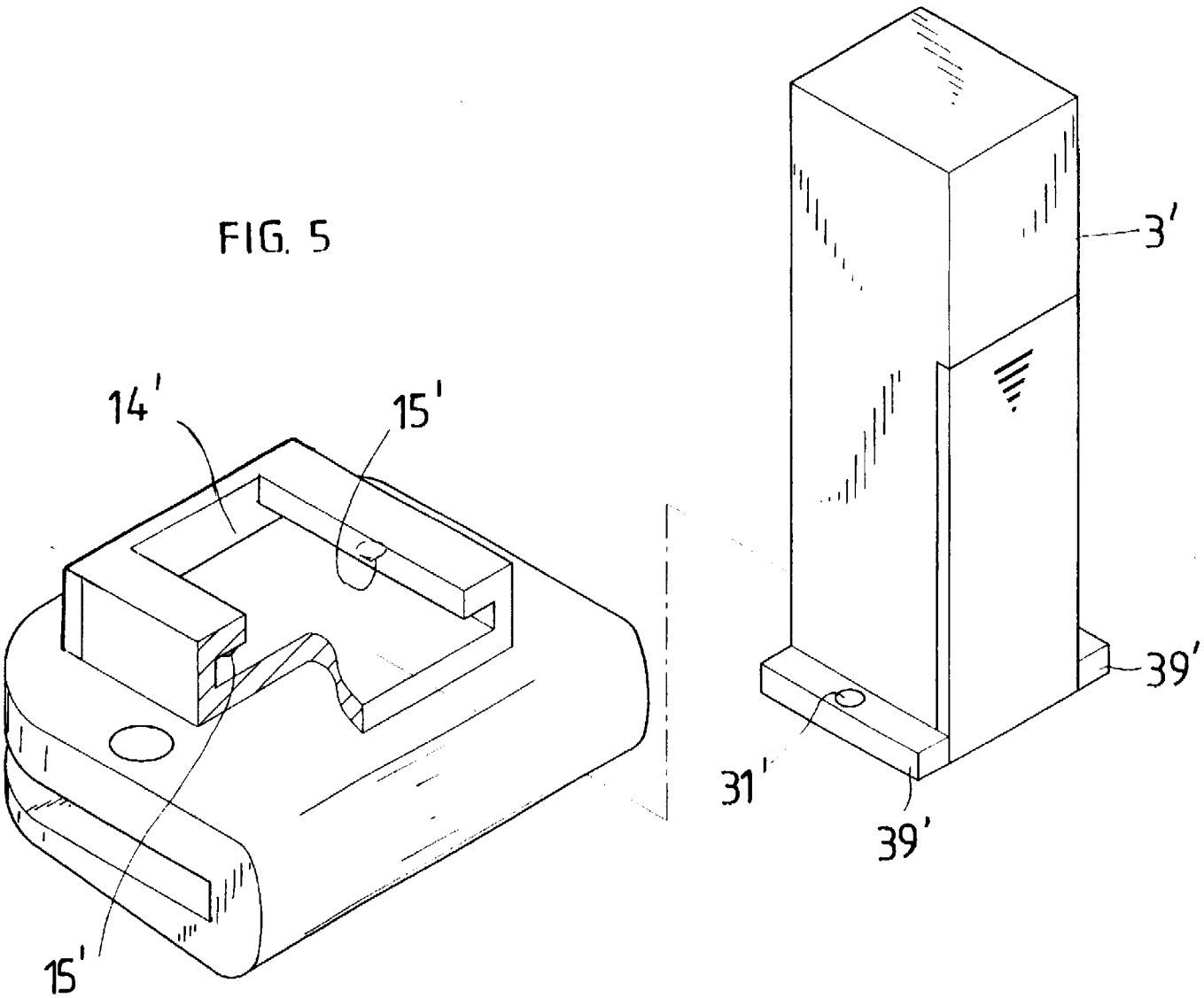
FIG. 5 is an exploded perspective of a second preferred embodiment of the present invention.

FIG. 5 illustrates another preferred embodiment of the present invention. In this embodiment, the clamping member 1 has a receiving seat 14' which is provided with two opposite rails and two electrode contacts 15' separately located in the rails, and a laser emitter 3' has two flanges 39' formed at two opposite bottom edges and two electrode contacts 31' separately provided on the flanges 39', such that the laser emitter 3' is firmly received in the receiving seat 14' by engaging the two flanges 39' into the two rails of the receiving seat 14' with the contacts 31' contacting with the contacts 15'. With this arrangement, the same function as provided by the first embodiment illustrated in FIG. 1 can be achieved in the second embodiment, too. The merit of this second embodiment of the present invention lies in that the laser emitter 3' can be more stably attached to the clamping member 1.

What is claimed is:

1. A laser aiming device removably mounted on a putter, comprising:

a clamping member having an upper and a lower legs connected at one end to together define a sideward opening for said clamping member, allowing said clamping member to be attached to a rear edge of a head portion of said putter by engaging said rear edge of said putter into said side opening of said clamping member; said upper leg being provided on a top surface with a receiving seat; said receiving seat being provided on inner side wall surfaces with two first electrode contacts which are electrically connected to a pressure switch provided at a bottom surface of said lower leg of said clamping member; and a laser emitter comprising a housing of which a lower part is suitable for locating in said receiving seat on said clamping member, said housing having accommodated therein an adequate number of batteries, a laser producing means for emitting an upward laser beam, and a mirror for reflecting said laser beam emitted by said laser producing means so that said laser beam emits out of said housing in a substantially horizontal but slightly downward inclined direction; a metal spring being disposed between said laser producing means and said batteries to electrically connect them and to, together with a push plate connected to an inner bottom surface of said housing, hold said batteries in place; said housing being provided at outer wall surfaces with two second electrode contacts to separately connect with said push plate and an extension plate while said extension plate has one end connected to a contact on said laser producing means, whereby when said housing is put into said receiving seat of said clamping member, said two second electrode contacts of said laser emitter contact with said two first electrode contacts of said receiving seat to form a closed circuit for said laser aiming device; and whereby when said pressure switch at the bottom surface of said lower leg of said clamping member contacts with ground and is depressed, above said circuit is electrically connected to cause said laser producing means to emit a laser beam which is reflected by said mirror in said housing and be emitted out of said housing to aim at a target.

2. A laser aiming device removably mounted on a putter as claimed in claim 1, wherein said upper leg of said clamping member is provided with threaded holes for screws to thread into, so that said upper leg together with said lower leg tightly clamp said rear edge of said head portion of said putter between them.

3. A laser aiming device removably mounted on a putter as claimed in claim 1, wherein said clamping member is attached to said rear edge of said head portion of said putter by means of adhesive.

4. A laser aiming device removably mounted on a putter as claimed in claim 1, wherein said housing of said laser emitter includes an openable door to facilitate replacement of said batteries.

5. A laser aiming device removably mounted on a putter as claimed in claim 1, wherein said receiving seat is a square framework and said housing of said laser emitter has a square lower portion for directly inserting into said square receiving seat.

6. A laser aiming device removably mounted on a putter as claimed in claim 1, wherein said receiving seat has two opposite rails and said housing of said laser emitter has two flanges provided at two opposite bottom edges of said housing, such that said housing can be slided into and connected to said receiving seat by engaging said two flanges into said two rails.

* * * * *